US008683758B2

(12) United States Patent
Christopoulos et al.

(10) Patent No.: US 8,683,758 B2
(45) Date of Patent: Apr. 1, 2014

(54) CAST STRUCTURAL YIELDING FUSE

(76) Inventors: Constantin Christopoulos, Toronto (CA); Jeffrey Alan Packer, Toronto (CA); Michael Gray, Toronto (CA)

( * ) Notice: Subject to any disclaimer, the term of this patent is extended or adjusted under 35 U.S.C. 154(b) by 667 days.

(21) Appl. No.: 12/600,067

(22) PCT Filed: May 15, 2008

(86) PCT No.: PCT/CA2008/000937

§ 371 (c)(1),
(2), (4) Date: Nov. 13, 2009

(87) PCT Pub. No.: WO2008/138143

PCT Pub. Date: Nov. 20, 2008

(65) Prior Publication Data

US 2010/0205876 A1 Aug. 19, 2010

Related U.S. Application Data

(60) Provisional application No. 60/917,952, filed on May 15, 2007.

(51) Int. Cl.
*E04B 1/98* (2006.01)

(52) U.S. Cl.
USPC ..... 52/167.3; 52/573.1; 52/719; 248/560

(58) Field of Classification Search
USPC ..... 52/167.3, 146, 167.1, 719, 573.1, 52/167.7, 638, 655.1, 656.9; 403/108, 403/302, 306, 2, DIG. 15; 248/560, 562, 248/564
See application file for complete search history.

(56) References Cited

U.S. PATENT DOCUMENTS

| | | | | |
|---|---|---|---|---|
| 4,823,522 | A | 4/1989 | White | |
| 4,910,929 | A | 3/1990 | Scholl | |
| 5,533,307 | A | 7/1996 | Tsai et al. | |
| 6,516,583 | B1 * | 2/2003 | Houghton | 52/655.1 |
| 6,530,182 | B2 | 3/2003 | Fanucci et al. | |
| 6,701,680 | B2 | 3/2004 | Fanucci et al. | |
| 6,837,010 | B2 * | 1/2005 | Powell et al. | 52/167.3 |
| 6,855,061 | B2 * | 2/2005 | Simboli | 464/182 |
| 7,065,927 | B2 | 6/2006 | Powell et al. | |
| 7,174,680 | B2 | 2/2007 | Smelser | |
| 7,797,886 | B2 * | 9/2010 | Su | 52/167.1 |
| 2001/0000840 | A1 | 5/2001 | Takeuchi et al. | |
| 2003/0205008 | A1 * | 11/2003 | Sridhara | 52/167.3 |
| 2004/0074161 | A1 * | 4/2004 | Kasai et al. | 52/167.1 |
| 2004/0211140 | A1 * | 10/2004 | Suzuki et al. | 52/393 |
| 2005/0005539 | A1 * | 1/2005 | Nakamura et al. | 52/167.3 |
| 2005/0055968 | A1 * | 3/2005 | Takeuchi et al. | 52/720.1 |
| 2005/0108959 | A1 * | 5/2005 | Powell et al. | 52/167.1 |
| 2006/0101733 | A1 * | 5/2006 | Jen et al. | 52/167.1 |
| 2007/0056225 | A1 * | 3/2007 | Takeuchi et al. | 52/167.1 |
| 2007/0253766 | A1 * | 11/2007 | Packer et al. | 403/187 |

* cited by examiner

*Primary Examiner* — Branon Painter
(74) *Attorney, Agent, or Firm* — Miller Thomson LLP; Eugene Gierczak

(57) ABSTRACT

A yielding fuse device is provided for use in association with a brace member in a bracing assembly for a structural frame. The device includes arms or elements that yield flexurally when a bracing member moves in an axial direction, with the bracing assembly under either tension or compression loading conditions. The device of the present invention is particularly useful as a mass customized cast device. The device is well suited for seismic bracing applications.

43 Claims, 18 Drawing Sheets

Displaced Shape of Fuse Yielding in Compression

Displaced Shape of Fuse Yielding in Tension

Undisplaced Fuse Assembly

Displaced Shape of Fuse Yielding in Compression

Displaced Shape of Fuse Yielding in Tension

Undisplaced Fuse Assembly

CAST STRUCTURAL YIELDING FUSE

PRIORITY

This application claims the benefit of U.S. Provisional Patent Application No. 60/917,952, filed on May 15, 2007.

FIELD OF THE INVENTION

This invention relates to structural members for use in the construction industry. The present invention in particular relates to cast structural members for seismic applications.

BACKGROUND OF THE INVENTION

Many building structure designs include the use of diagonal braces to provide lateral stability, especially for the purpose of increasing the lateral stiffness of the structure and reducing the cost of construction. In such bracing systems it is known that one or more sacrificial yielding fuse elements may be implemented in order to dissipate seismic input energy in the event of dynamic loading, such as during a severe seismic event. Such sacrificial yielding fuse elements are selected because they lead to improved seismic performance and reduced seismic loads when compared to traditional lateral load resisting systems.

For example, U.S. Pat. Nos. 6,530,182 and 6,701,680 to Fanucci et al. describe an energy absorbing seismic brace having a central strut surrounded by a spacer and sleeve configuration.

Similarly, U.S. Pat. Nos. 6,837,010 and 7,065,927 and U.S. Patent Application Publication No. 2005/0108959 to Powell et al. describe a seismic brace comprising a shell, containment member and a yielding core.

Brace apparatuses are also disclosed in U.S. Pat. No. 7,174,680 and U.S. Patent Application Publication No. 2001/0000840.

Most of these prior art systems require a buckling restraining apparatus used in conjunction with a yielding member, and are generally formed of steel plates and are not cast. Further, these prior art systems make use of axially yielding members, whereas it would be advantageous to use flexural yielding elements as they are less prone to fracture caused by excessive inelastic straining.

U.S. Pat. No. 4,823,522 to White, U.S. Pat. No. 4,910,929 to Scholl and U.S. Pat. No. 5,533,307 to Tsai and Li all describe steel yielding fuse elements that are placed at the centre of a beam and are used to add damping and stiffness to a seismically loaded moment resisting frame. The damping elements are generally formed with steel plates that are cut into triangular shapes and welded or bolted to a rigid base. Also, these elements are generally installed at the centre of the upper brace in and inverted V-type braced frame. Thus the yielding of these elements is controlled by the inter-story displacement of the frame. However, a yielding element that was linked to the brace elongation rather than the inter-story displacement would integrate more easily with current construction practices.

Another prior art fuse system, the EaSy Damper, uses a complex fabricated device to improve the seismic performance of brace elements by replacing axial yielding and buckling of the brace with combined flexural and shear yielding of a perforated, stiffened steel plate. The shapes of these plates do not result in constant curvature of the yielding elements and thus lead to undesirable strain concentrations.

Both of the aforementioned prior art systems require painstaking cutting and welding fabrication. Furthermore, the limited geometry of currently available rolled steel products restricts the potential geometry of the critical yielding elements of such devices.

Having greater control of the geometry of the flexural yielding elements permits control of not only the force at which the fuse yields, but also the elastic and post yield stiffnesses of the fuse as well as the displacement associated with the onset of fuse yielding. With casting technology a better performing fuse can be designed and manufactured. Also, free geometric control would enable the design of a part that would more easily integrate with existing steel building erection and fabrication practices than the prior art.

In view of the foregoing, an improved yielding fuse member for dynamic loading applications is desirable.

SUMMARY OF THE INVENTION

The present invention is directed to a yielding fuse device and bracing assembly including the device.

In one embodiment, the present invention is a structural device for use in a brace assembly for a structural frame, the brace assembly including a brace member, the device comprising: a first end configured to receive the brace member and be connected to the brace member; a second end adapted to be connected to the structural frame; and an eccentric yielding arm. An unstable sway-type collapse is prevented by constraining movement of the brace member to the axial direction only. The yielding arm is preferably tapered to facilitate yielding of the entire arm rather than having a localized yielding which can result in premature fracture due to excessive inelastic straining.

In another embodiment, the present invention is a structural device for use in a brace assembly for a structural frame, the brace assembly including a brace member, the device comprising: an end portion configured to receive the brace member and be connected to the brace member; and a body portion disposed generally away from an axis defined by the brace member, the body portion including a plurality of eccentric yielding arms extending toward the central axis, the yielding elements including top portions adapted to be connected to the structural frame.

Advantageously, the yielding element(s) in the device is cast and therefore yielding behaviour can be carefully controlled by varying the cross-section and geometry of the yielding arm along its length. Further, the yielding device of the present invention operates to yield in a bracing assembly under the action of both tension and compression loading of the brace, and since the device yields flexurally, it is therefore less prone to fracture caused by excessive inelastic strains. Finally, a plurality of devices can be implemented in each bracing assembly, allowing for scalability.

Further features of the invention will be described or will become apparent in the course of the following detailed description.

BRIEF DESCRIPTION OF THE DRAWINGS

A detailed description of the preferred embodiments is provided herein below, by way of example only, and with reference to the following drawings, in which.

DETAILED DESCRIPTION OF THE INVENTION

Figure 1:
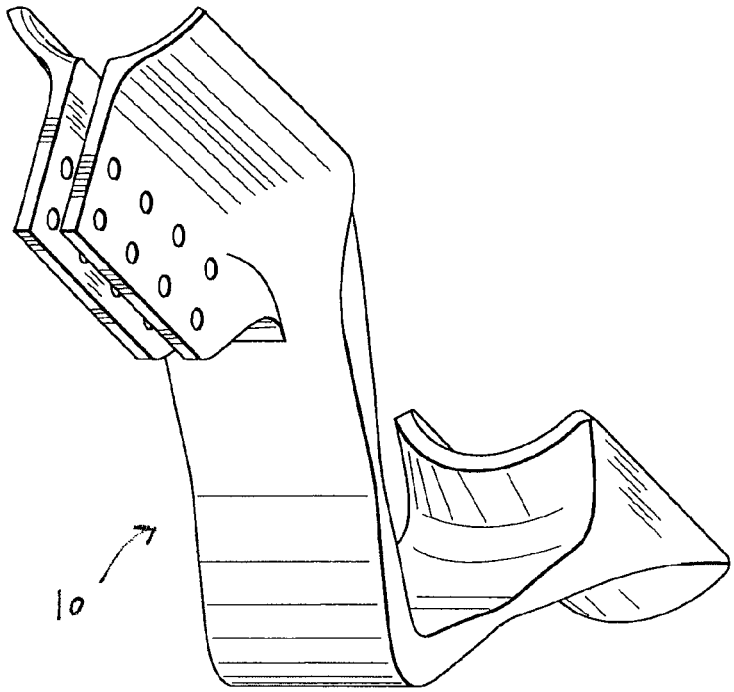
FIG. 1 is a perspective view of a yielding fuse member in accordance with a first embodiment of the present invention.
Figures 2A, 2B, 2C, 2D, 2E:
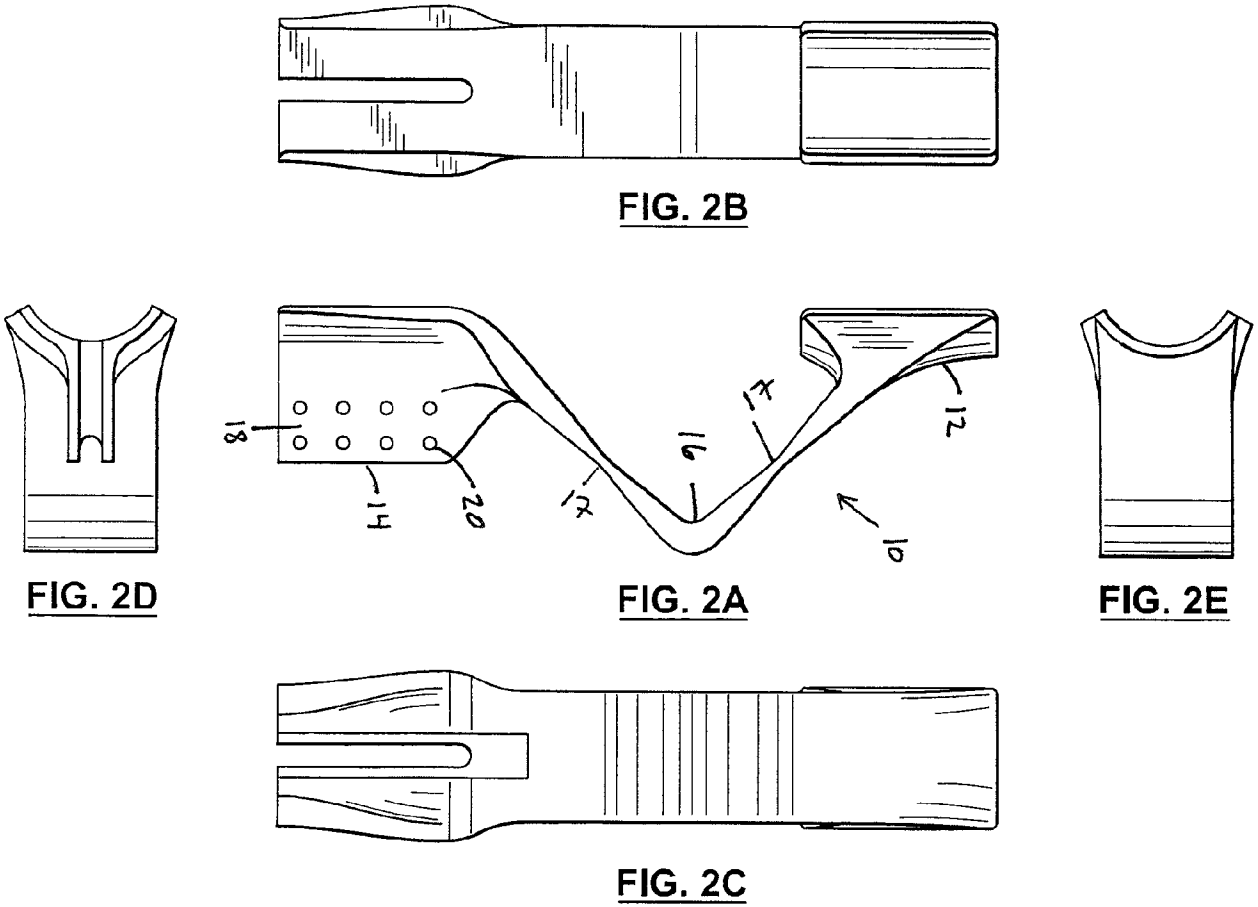
FIGS. 2A, 2B, 2C, 2D and 2E are a side, top, bottom, second end and first end view, respectively, of the yielding fuse member in accordance with a first embodiment of the present invention.

The yielding fuse devices of the present invention are particularly useful as mass-customized cast steel or other cast metal devices for primarily axially-loaded members. The devices may be used with hollow structural sections, pipes and other shaped structural sections such as W-sections. The devices are designed to act as a yielding fuse in a braced frame subjected to dynamic loading, including extreme dynamic loading, such as in severe seismic loading conditions. The devices serve to protect the brace member and the structural frame from excessive damage during dynamic loading conditions (i.e. an earthquake) by absorbing the majority of the energy. What is meant by "dynamic loading conditions" is repeated cycles of tension and compression yielding, including the increase in strength that is expected as the yielding fuse reaches large inelastic strains (due to overstrength or second order geometric effects). The devices can be incorporated into an end connector or can be placed intermediately within the brace member. The devices could be used to form a mass-produced, standardized product line of connectors that each yield at a different load such that the product line included sufficient connectors to cover a range of expected brace forces.

The devices of the present invention operate by replacing the axial tensile yielding and inelastic buckling of a typical brace with predominantly flexural deformation of specially designed yielding element arms. Because the devices may be cast, the geometry of the yielding elements of the fuse and the cast metal can be specifically designed so that the arms provide optimal combinations of yield force, stiffness and ductility. The devices are also designed to yield in a stable manner.

A first possible embodiment of the structural yielding devices of the present invention is shown in FIGS. 1 to 5. The yielding device 10 includes a first end 12 configured to receive a brace member 22 and be connected, for example welded, to the brace member, a second end 14 adapted to be connected to the brace assembly end connection 24, and at least one flexural yielding arm 16. As shown in the drawings, the first end 12 and the second end 14 may be within a same axis defined by the brace member 22. As shown in the drawings, the brace member 22 can be tubular and the first end 12 can include a curvature corresponding to a curvature of the brace member. Another embodiment of the yielding device 10 could include a first end 12 that is shaped to accept a W-section type brace member 22, for example. The connection at the first end 12 of the device 10 may require sufficient strength to resist the axial, shear and flexural forces that are imparted during cyclic inelastic deformation of the yielding arms 16 that may occur during dynamic loading conditions such as an earthquake. This design should be carried out in accordance with well known seismic design methodologies as described in most structural steel design codes. The aim of this methodology is to protect all components of a structure when the yielding elements develop their over strength.

In one embodiment of the present invention, the first end 12 is welded to the brace member 22. The yielding arm 16 is offset from an axis defined by the brace member 22, i.e. the yielding arm is eccentric. As a result the yielding arm transmits the axial force in the brace 22 to the brace assembly end connection 24, for example a gusset plate, through a combination of axial force, shear and flexure.

Figure 4B:
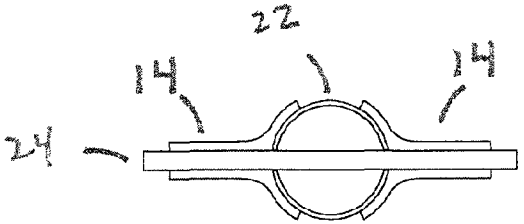
FIGS. 4A, 4B, 4C and 4D are a side view and section views of the yielding fuse member in accordance with a first embodiment of the present invention in a standard braced frame.
Figure 4C:
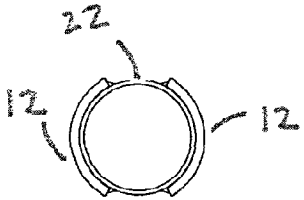
Figure 4D:
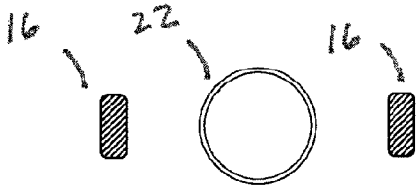

In accordance with a particular aspect of the present invention, the at least one yielding arms 16 are tapered. The tapered regions ensure that the whole arm 16 is subject to a nearly constant curvature when the brace member is loaded axially. This ensures that when the desired yield force is achieved the entire length of the arm is subject to yielding rather than just yielding at one or more discrete hinge locations. This reduces the strain in the arms, thus significantly decreasing the likelihood of premature fracture during inelastic loading. Different cross sections may be used for the yielding arm 16, for example rectangular cross section, as shown in FIG. 4D. The yielding arm 16 should be oriented such that it is bending primarily about the weak flexural axis of the cross-section. This eliminates the potential for an unstable out-of-plane lateral torsional buckling failure.

Figure 3:
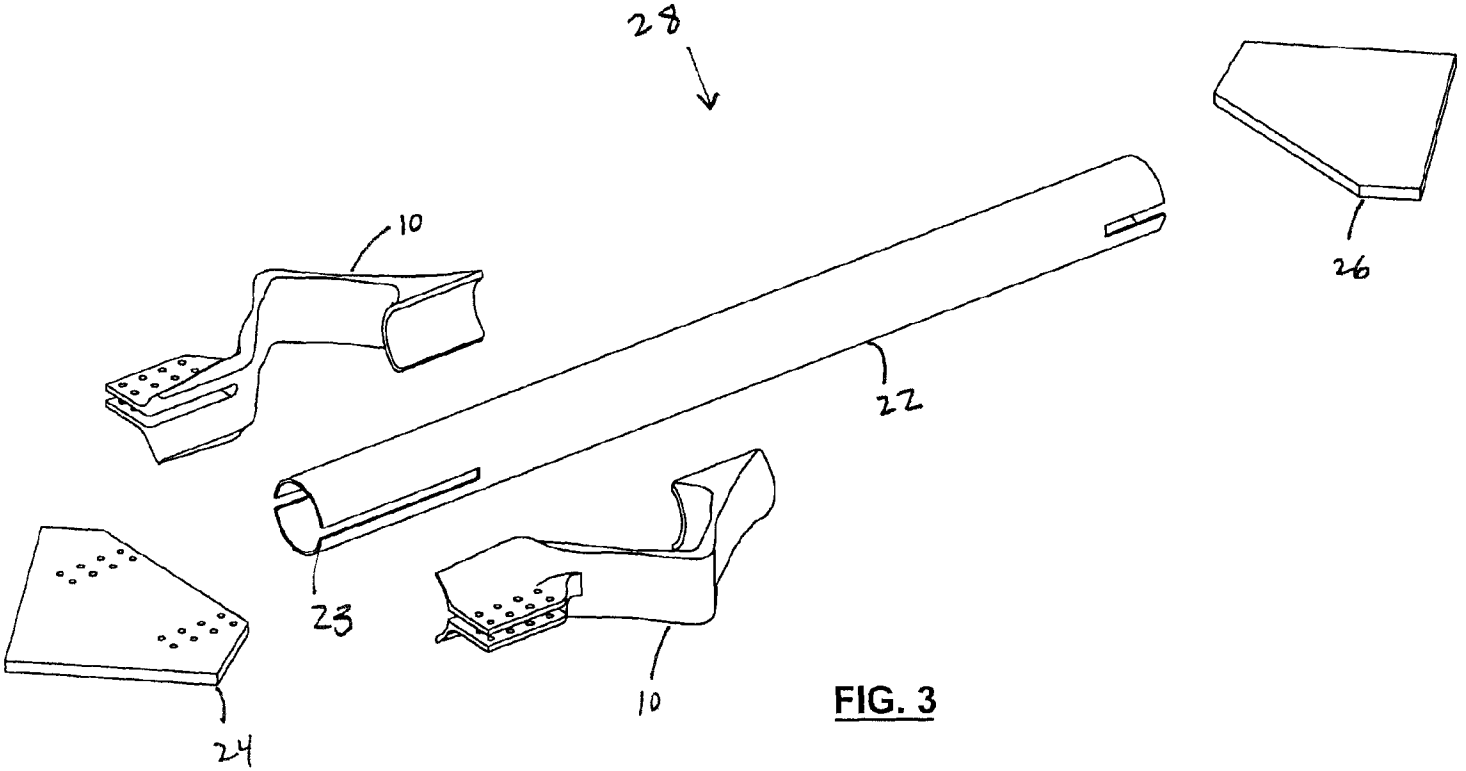
FIG. 3 is an exploded perspective view of two yielding fuse members in accordance with a first embodiment of the present invention aligned with a brace member and a gusset plate.

According to one particular embodiment as shown in FIG. 3, a brace assembly 28 for a structural frame includes a brace member 22 and at least two yielding devices 10. The brace assembly may further include an assembly end connection 24, for example a gusset plate, and a means for connecting a distal end of the brace member 22, for example, a second gusset plate 26 and a standard welded or bolted detail (bolted option not shown). The second end 14 may include one or more flange portions 18 which may be configured with holes 20 for attachment to a brace assembly end connection, being a gusset plate 24, for example. The holes 20 in the one or more flange portions 18 generally correspond with holes present in a gusset plate 24 allowing the second end 20 to be fixed to a gusset plate 24 by bolts. In one embodiment of the present invention, there are two opposing flange portions 18, each of the flange portions 18 disposed on either side of a gusset plate 24 when assembled as a brace assembly 28. It is understood that the flange portions 18, bolts and assembly end connection 24, may require providing a minimum strength to resist the axial, shear and flexural forces that are imparted by the yielding arm 16 during cyclic inelastic deformation of that arm 16 that occurs during a dynamic loading condition. The design of these elements should be carried out in accordance with well know seismic design methodologies as described in most structural steel design codes.

Two yielding devices 10 may be implemented in a brace assembly 28, providing symmetrical yielding during axial loading, either compressive or tensile. However, as would be appreciated by a person skilled in the art, other symmetrical configurations comprising three or more yielding devices 10 are possible.

In accordance with another aspect of the present invention, the device 10 includes a restraining means allowing only axial movement of the brace member 22 to prevent an unstable failure mechanism, i.e. a sway failure mechanism of the yielding arms 16. For example, as shown in FIG. 4B the second end 14 includes curved portions adjacent to the flange portions 18, the curved portions for restraining movement of the brace member 22 to movement only in an axial direction. Furthermore, the brace member 22 can include a slot 23 which allows it to slide freely in the axial direction over the gusset plate 24 while further limiting out of plane rotation of the brace member 22. The slot 23 may be provided such that it is sufficiently long to accommodate both tensile and compressive axial brace displacements at least twice the expected brace deformation when subjected to a dynamic loading condition. The expected brace deformation is derived from analysis of the structure under the seismic loading that is prescribed by the prevailing seismic design code. This is only an example of one method of limiting the brace deformation to the axial direction. A person skilled in the art would appreciate that there may be many means to achieve the desired restraint.

Figure 4A:
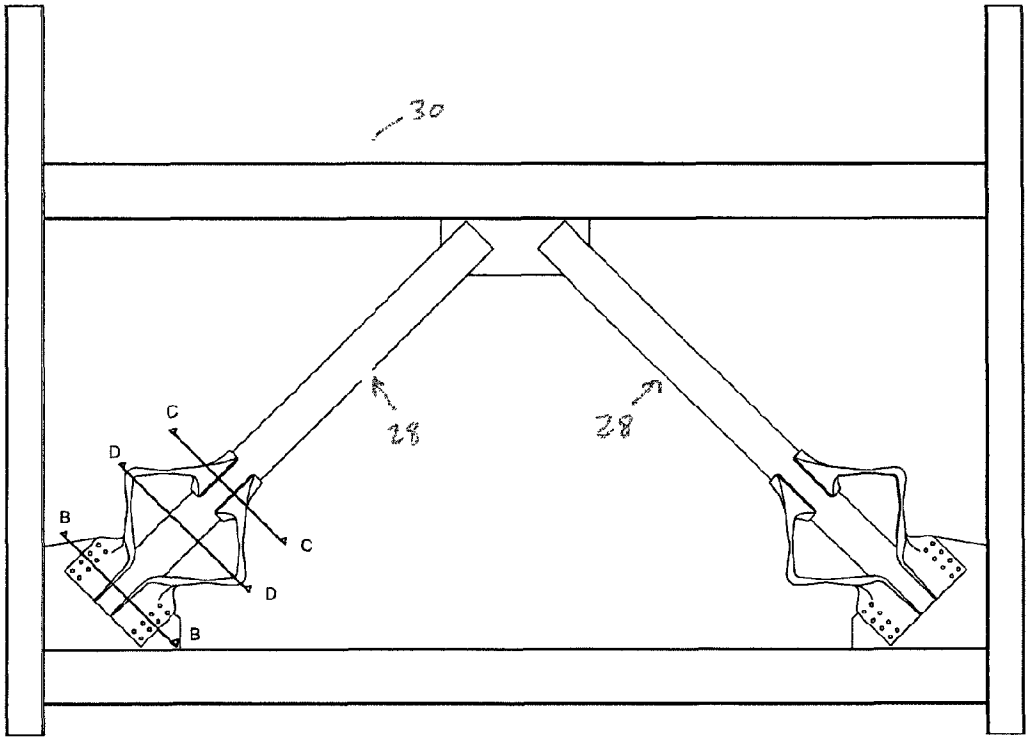

As shown in FIG. 4A, one or more brace assemblies 28 can be installed to brace a structural frame 30. The device 10 included in a brace assembly 28 acts to dissipate energy arising from dynamic loading conditions through the flexural yielding of the yielding arms 16. The connecting portions of the device 10, namely the first end 12 and the second end 14, are intended to remain elastic during a seismic event or other dynamic loading event. In order to utilize the opportunity for mass production that is presented by the casting process, the first end 12 is designed to attach to a range of brace members 22. As shown in FIG. 4C the first end 12 has a curvature that matches the curvature of the outer surface of the brace member 22 but can be used with hollow structural sections of varying wall thicknesses.

Figure 5C:
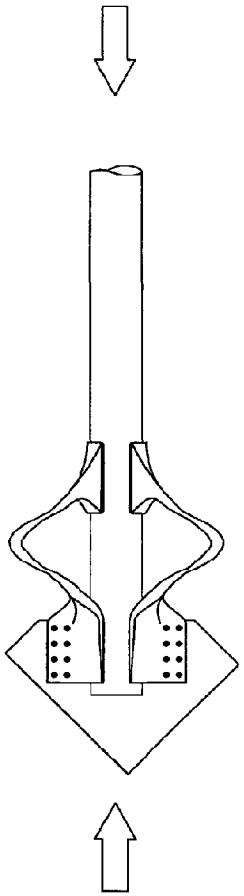
FIGS. 5A, 5B and 5C illustrates a fuse assembly including the yielding fuse member in accordance with a first embodiment of the present invention undisplaced, yielding in tension, and yielding in compression, respectively.
Figure 5B:
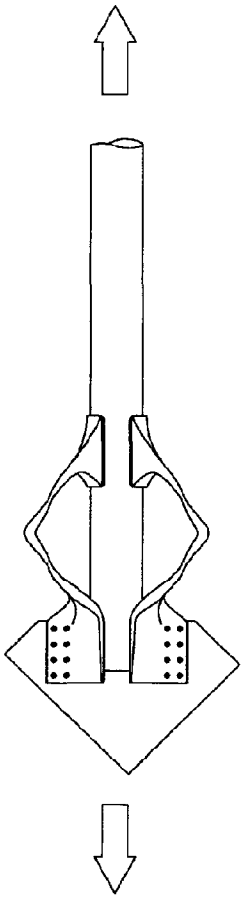
Figure 5A:
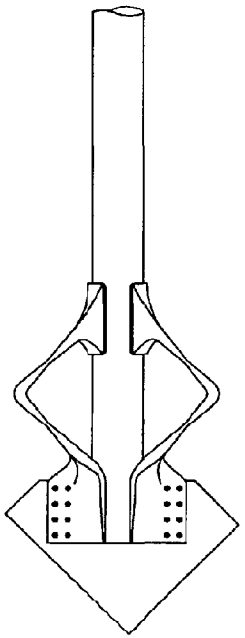
Figure 6:
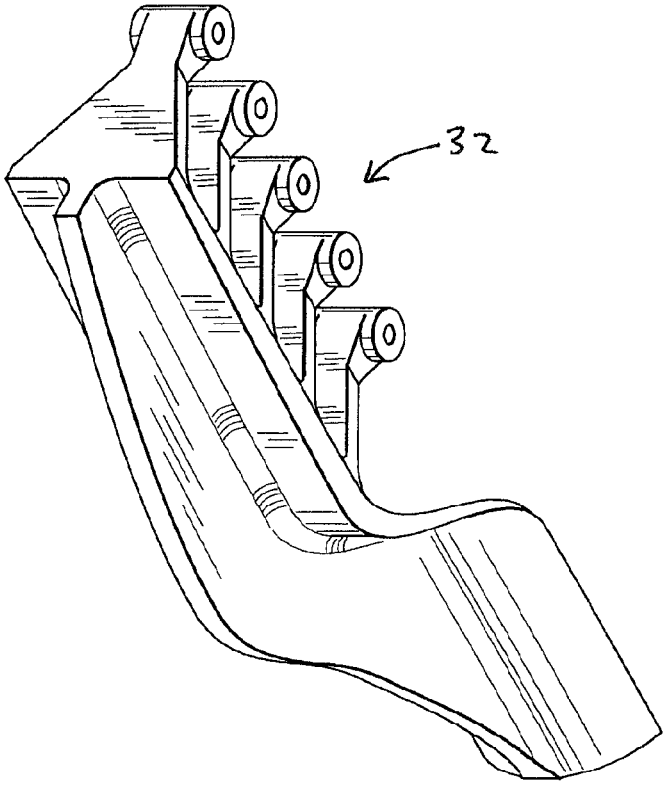
FIG. 6 is a perspective view of a yielding fuse member in accordance with a second embodiment of the present invention.
Figure 7E:
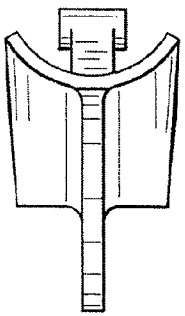
FIGS. 7A, 7B, 7C, 7D and 7E are a side, top, bottom, second end and first end view, respectively, of the yielding fuse member in accordance with a second embodiment of the present invention.
Figure 7C:
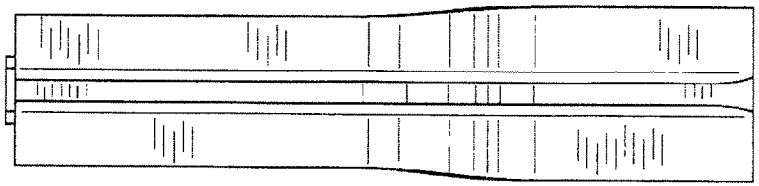
Figure 7A:
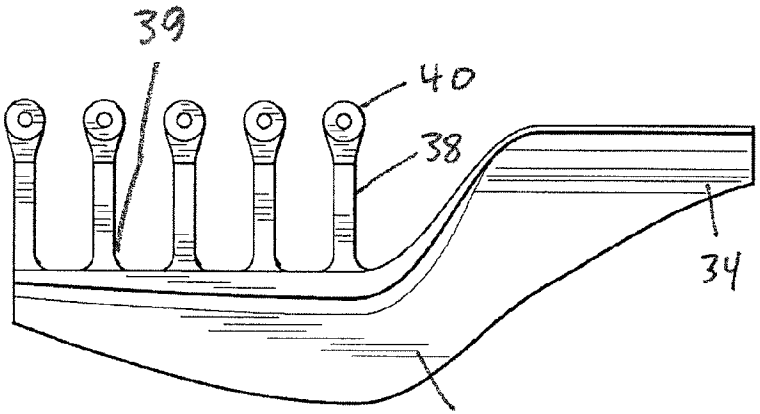
Figure 7B:
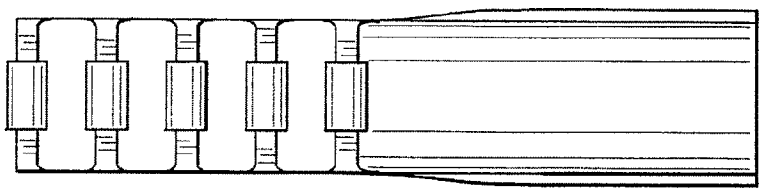
Figure 7D:
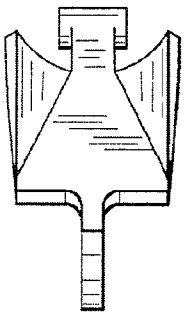

FIG. 5 illustrates the displacement of the fuse assembly in either tension or compression yielding.

A second possible embodiment of the yielding fuse devices of the present invention is shown in FIGS. 6 to 12. In this case, the structural yielding device 32 includes an end portion 34 configured to receive a brace member 22 and be connected to the brace member 22, and a body portion 36 disposed generally away from an axis defined by the brace member 22, the body portion 36 including a plurality of flexural yielding arms 38 extending toward the axis, the yielding arms 38 including base portions 39 and top portions 40. The yielding device 32 is operable to dissipate energy arising from dynamic loading conditions, such as seismic energy, through the formation of flexural plastic hinges in the yielding arms 38. One or more splice plates 42 may be provided to retain the top portions 40 of the yielding arms 38. The splice plate(s) 42 can retain the top portions 40 by bolts which pass through slotted holes in the splice plates 42 and through holes in the tops 40 of the yielding arms 38. This allows the tops 40 of the yielding arms 38 to rotate and translate in relation to the splice plate 42 thus avoiding the development of severe axial forces in the yielding arms 38. In another embodiment (not shown) the tops 40 of the yielding arms 38 could be cast as solid cylinders that would be directly restrained by the slotted holes in the splice plates 42. In both cases the bolts or solid cylinders and their slots may be required to have sufficient strength to remain elastic and minimize deformations when the yielding arms 38 undergo cyclic inelastic deformations as expected in a dynamic loading condition event, such as an earthquake.

The yielding arms 38 may be tapered to encourage yielding along the entire length of the yielding arm and are eccentric to the axis of the brace member 22. In one aspect of the invention, the yielding arms 38 are tapered along their height rather than through their thickness. At both base portions 39 and top portions 40 of the yielding arms 38 the tapering may be changed such that portions 39 and 40 are thickened through both the thickness and the height in order to ensure that the yielding is contained within the intended tapered portion 38.

Figure 8:
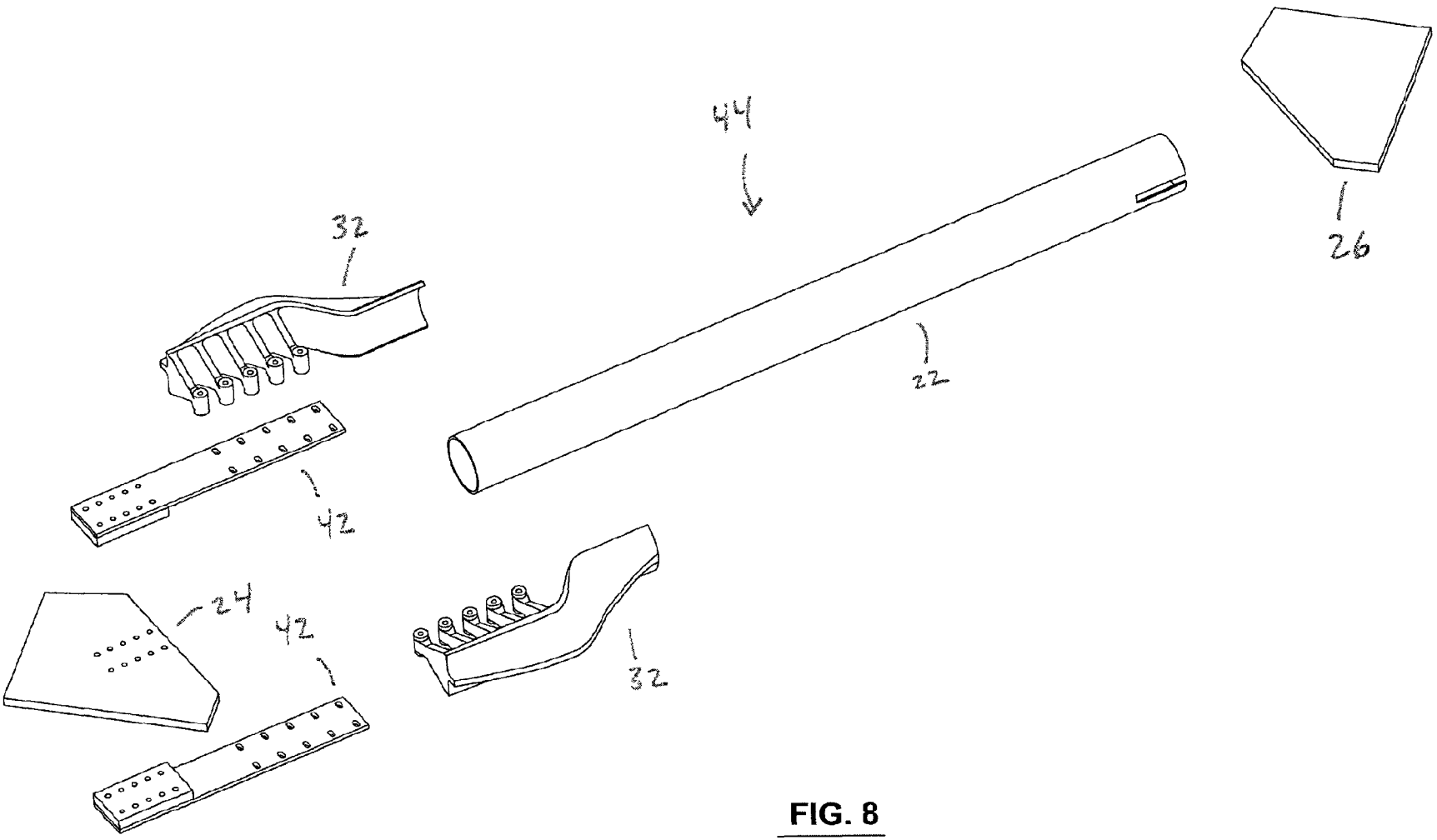
FIG. 8 is an exploded perspective view of two yielding fuse members in accordance with a second embodiment of the present invention aligned with a circular hollow section brace member, two joint plates and a gusset plate.

The end portion 34 of device 32 may include a shape corresponding to a shape of the brace member 22, which in the case of FIG. 8 is tubular and, therefore, the shape of first end 34 is a curvature that corresponds to the curvature of brace member 22. The connection at the first end 34 of device 32 may be required to have sufficient strength to resist the expected axial, shear and flexural forces that are imparted on it during the inelastic deformation of the yielding arms 38. In order to utilize the opportunity for mass production that is presented by the casting process, the first end 34 is designed to attach to a range of brace members 22. In the embodiment shown in FIG. 8 and FIG. 10B the first end 34 has a curvature that matches the curvature of the outer surface of the brace member 22 but can be used with hollow structural sections of varying wall thicknesses.

It is necessary for the proper function of device 32 that the body portion 36 is proportioned to ensure that it remains elastic during the cyclic inelastic deformations of the tapered yielding arms. The cross section of body portion 36 can be varied from the "T" cross section shown in FIG. 10C and FIG. 11C. The cross section of body portion 36 should be shaped to promote castability while best minimizing the weight of the part. The body portion 36 should also extend sufficiently beyond the end of the brace member 22 to leave a gap 46 that is at least twice the maximum expected axial brace deformation when subjected to a dynamic loading condition. The expected brace deformation is derived from analysis of the structure under the seismic loading that is prescribed by the prevailing seismic design code. Similarly, the splice plate 42 extends beyond the end of the gusset plate 24 to provide a gap 48 between the end of the structural device 32 and the end of the gusset plate 24.

Figure 9:
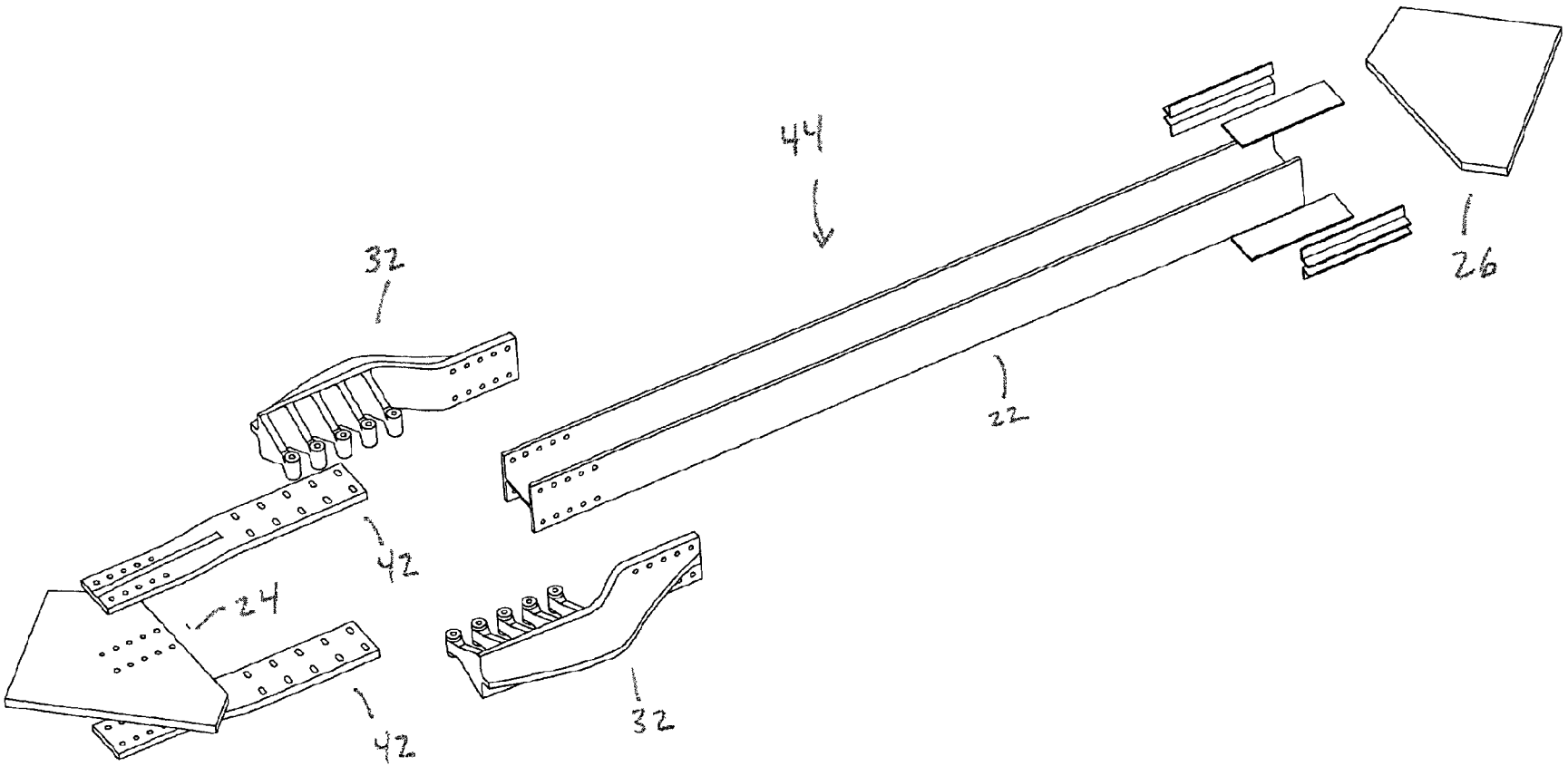
FIG. 9 is an exploded perspective view of two yielding fuse members in accordance with a second embodiment of the present invention aligned with a wide flange brace member, two joint plates and a gusset plate.
Figure 10B:
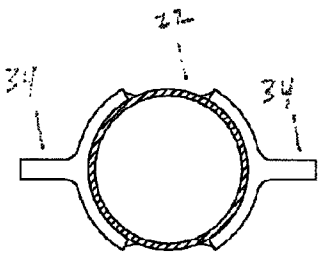
FIGS. 10A, 10B, 10C and 10D are a side view and section views of the connection regions of the yielding fuse member in accordance with a second embodiment of the present invention in a standard braced frame connected by means of welding to a circular hollow structural section brace member and by means of bolting to two joint plates.
Figure 10C:
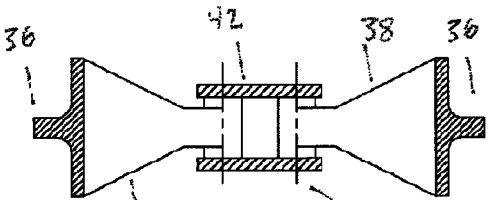
Figure 10D:
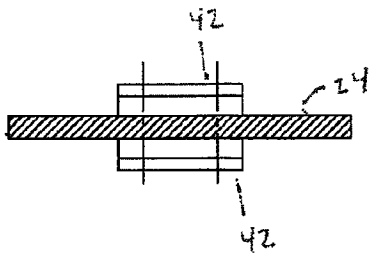
Figure 11B:
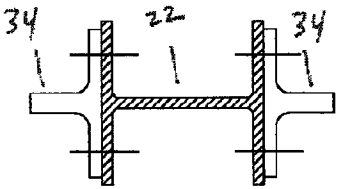
FIGS. 11A, 11B, 11C and 11D, are a side view and section views of the connection regions of the yielding fuse member in accordance with a second embodiment of the present invention in a standard braced frame connected by means of bolting to a wide flange section brace member and by means of bolting to two joint plates.
Figure 11C:
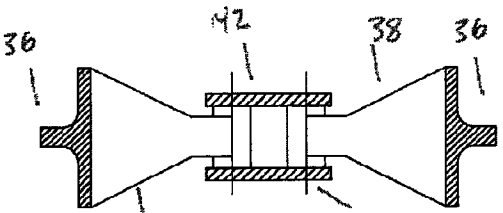
Figure 11D:
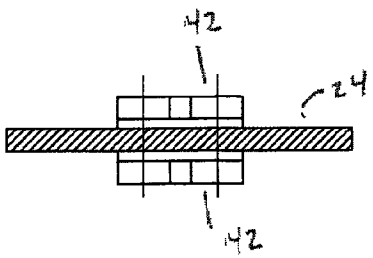

The end connection gusset plate 24 and the splice plate(s) 42 each have corresponding holes to allow the splice plate to be fixed to the gusset plate by bolts, with the holes in the splice plate slotted to allow translation and rotation of the top 40 of the yielding arms 38 when the device is yielding. In FIGS. 10C and 11C, the splice plate 42 includes two opposing portions for retaining the top portions 40 of the yielding elements 38. The splice plate 42 could be a cast steel component as shown in FIG. 9 or manufactured with rolled steel products as shown in FIG. 8. In either case the splice plate 42 and connections must be designed in order to remain elastic and rigid when subjected to the cyclic axial tension and compression that is imparted on it during the cyclic inelastic deformation of the yielding arms 38 that would occur during a dynamic loading condition.

According to one particular aspect as shown in FIG. 8, a brace assembly 44 includes a brace member 22, at least two yielding devices 32, an assembly end connection 24, such as a gusset plate, said assembly end connection including a splice plate 42, and a means for connecting a distal end of the brace member 22, for example a second gusset plate.

Figure 10A:
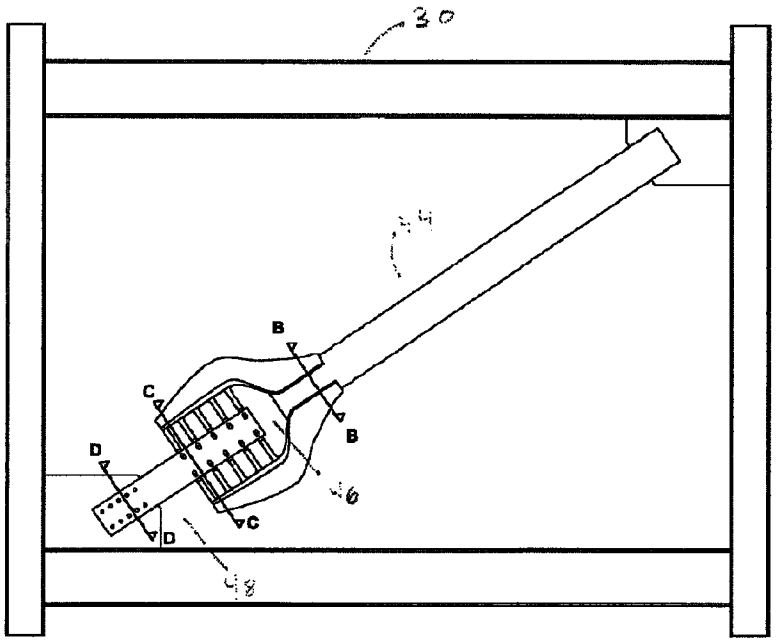
Figure 11A:
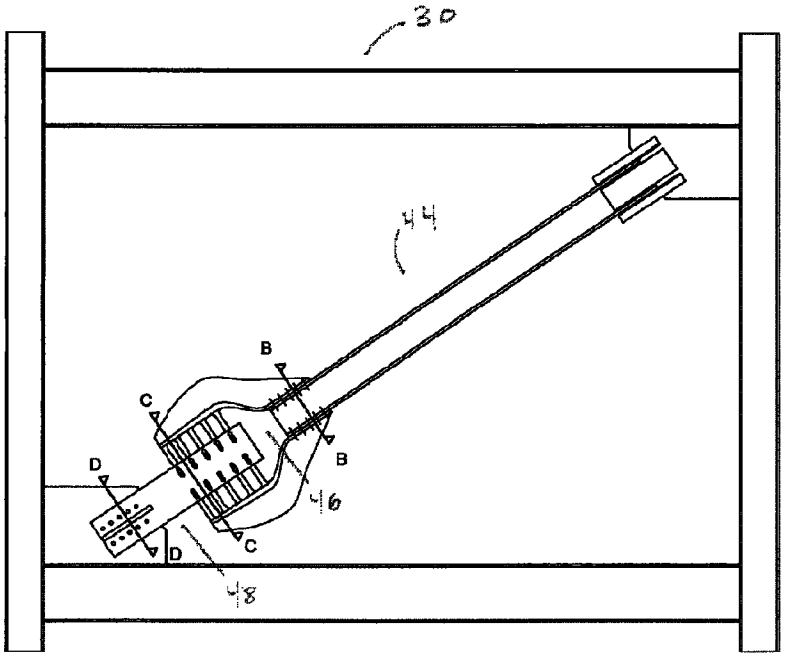
Figure 12C:
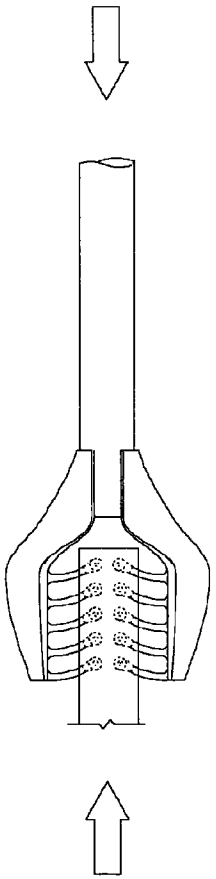
FIGS. 12A, 12B and 12C illustrate a fuse assembly including the yielding fuse member in accordance with a second embodiment of the present invention undisplaced, yielding in tension, and yielding in compression, respectively.
Figure 12B:
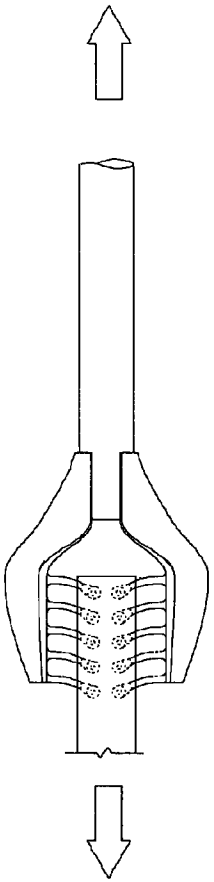
Figure 12A:
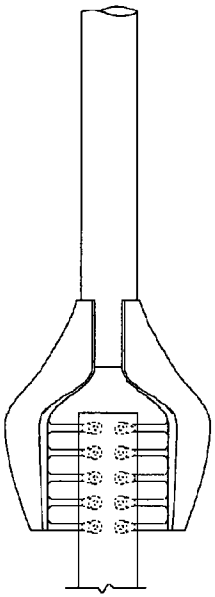

In one aspect, two yielding devices 32 are implemented in the brace assembly 44 as shown in FIGS. 10A and 11A, providing symmetrical yielding during severe axial loading. However, as would be appreciated by a person skilled in the art, other symmetrical configurations comprising three or more yielding devices 32 are of course also possible.

A brace assembly 44 may be configured with two yielding devices 32 to facilitate symmetric yielding response both in tension or compression (see FIG. 10). It should be understood that by virtue of the restraint provided by the splice plate(s) 42, the brace assembly 44 only yields in a generally axial direction defined by the axis of the brace member 22. In other words, the restraint provided by the splice plate(s) 42 prohibits out of plane buckling of the bracing assembly 44.

The yielding arms 38 may or may not be perpendicular to the axis of the brace member 22. Inclining the yielding arms 38 could result in an increase in the elastic stiffness of the system.

Figure 13:
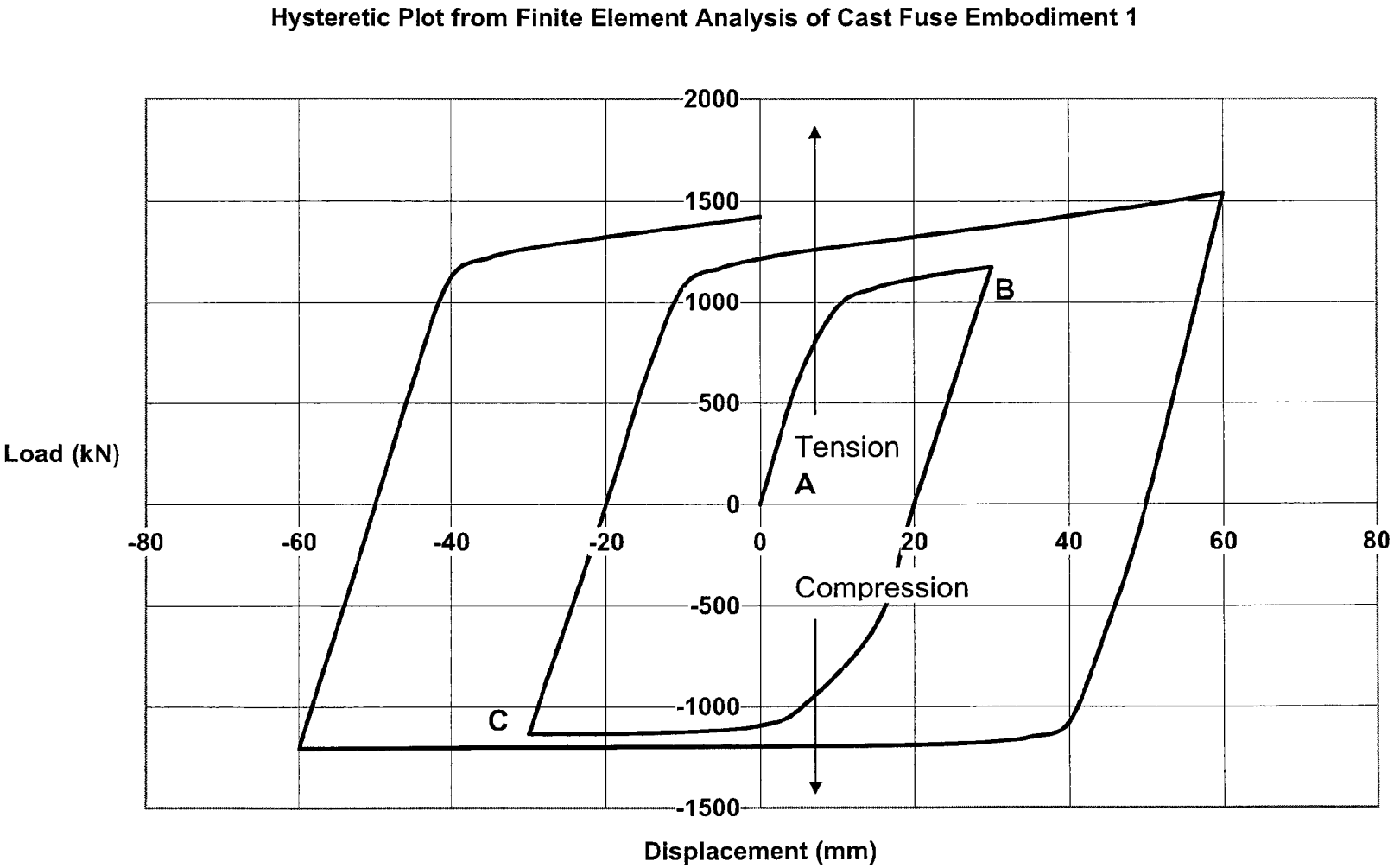
FIG. 13 is a hysteretic plot from non-linear finite element analysis of the yielding fuse member loaded several cycles of inelastic deformation in accordance with a first embodiment of the present invention.
Figure 14:
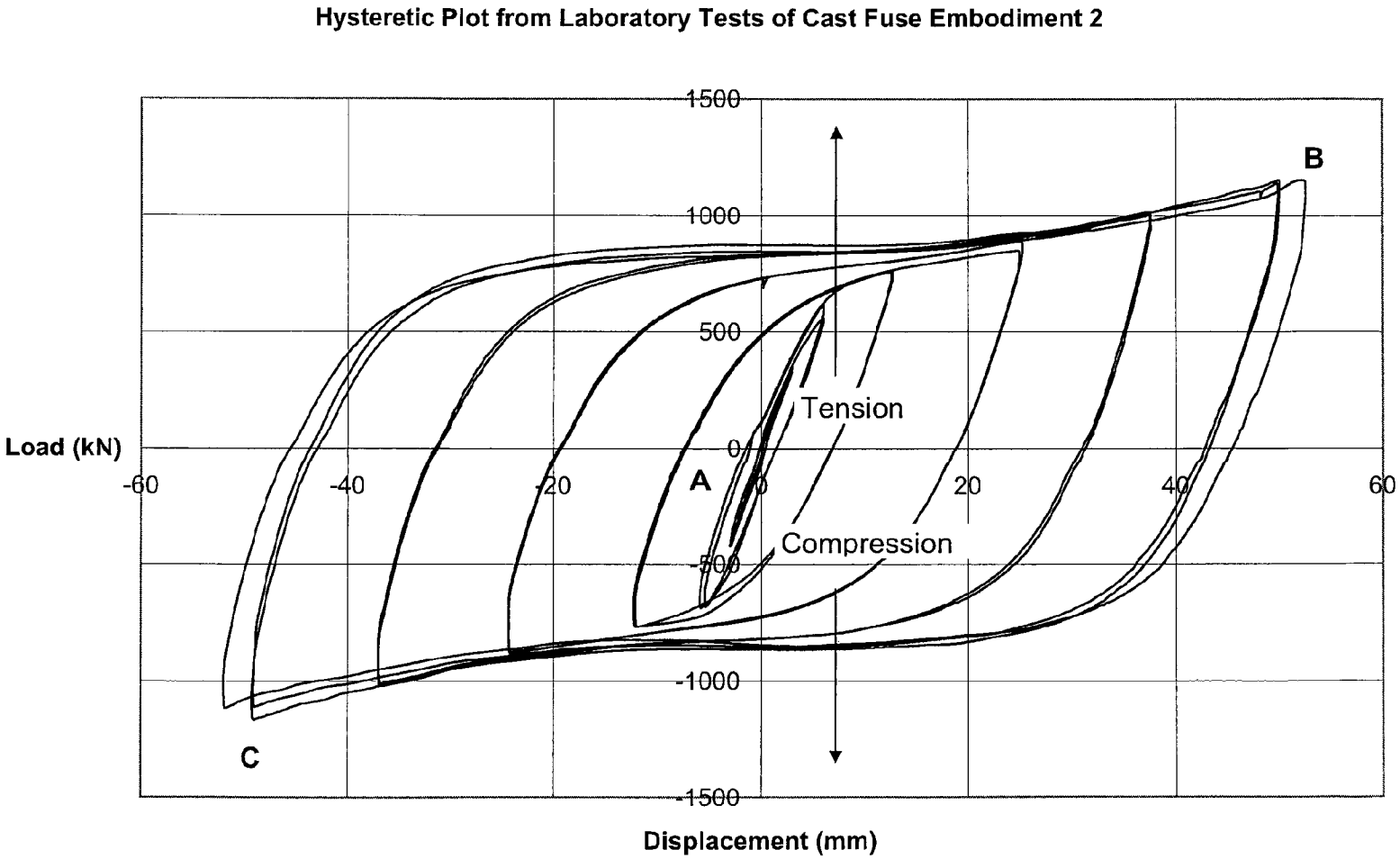
FIG. 14 is a hysteretic plot from laboratory tests of cyclically deformed tapered cast steel yielding arms in accordance with the yielding arms of a second embodiment of the present invention.
Figure 15:
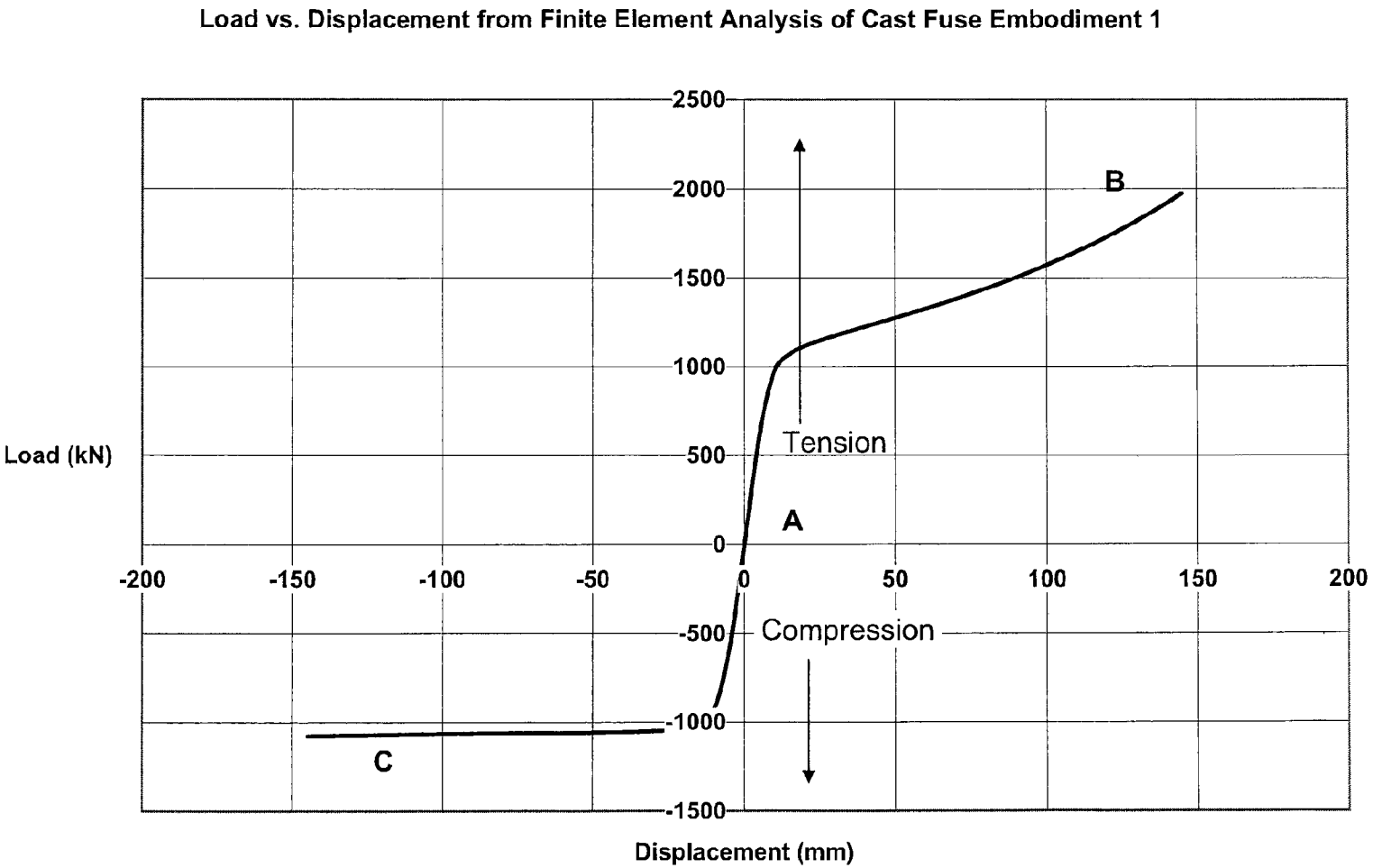
FIG. 15 is a static load versus displacement plot from non-linear finite element analysis of the yielding fuse member in accordance with a first embodiment of the present invention.
Figure 16:
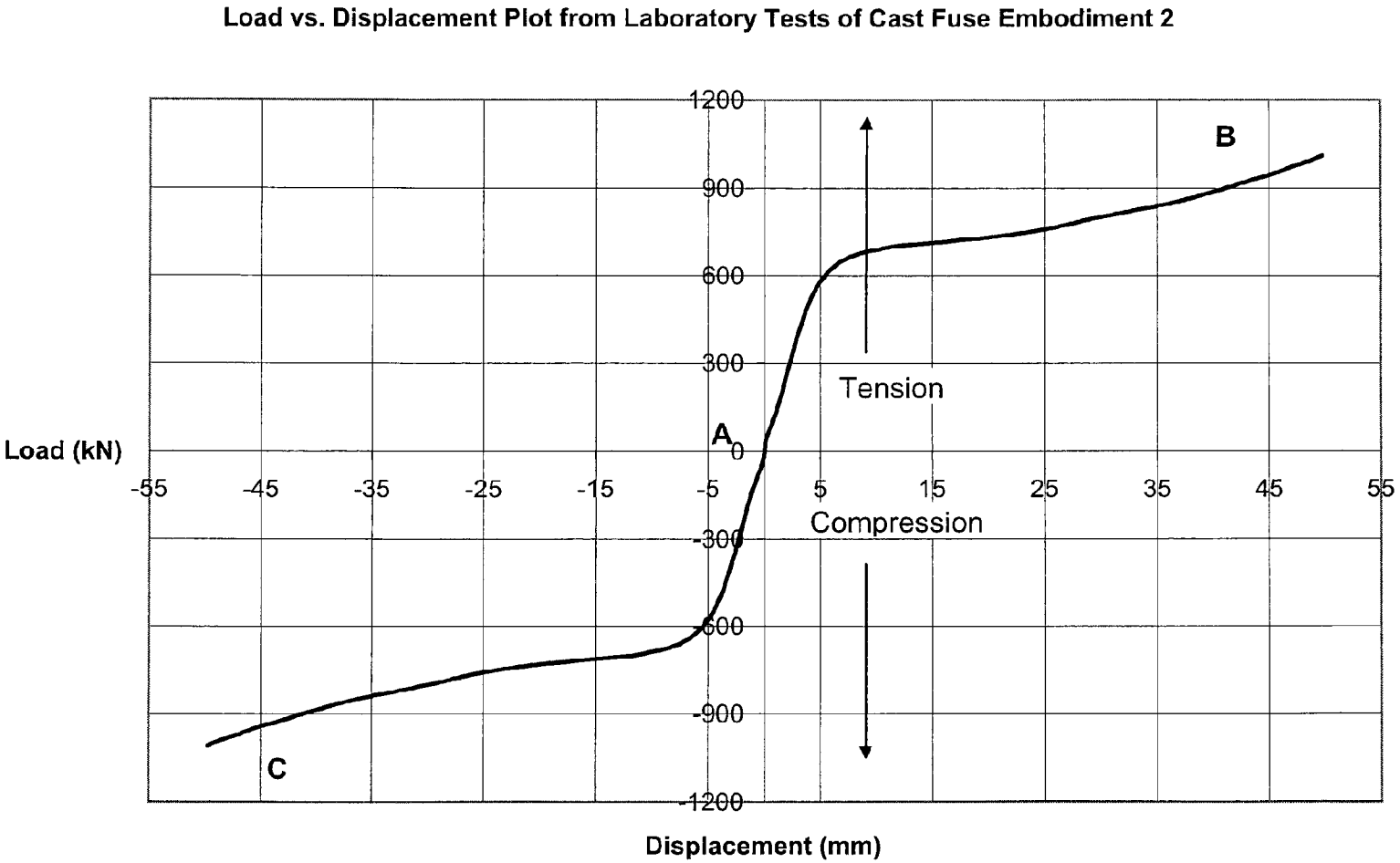
FIG. 16 is a static load versus displacement plot from laboratory tests of tapered cast steel yielding arms in accordance with the yielding arms of a second embodiment of the present invention.
Figure 17:
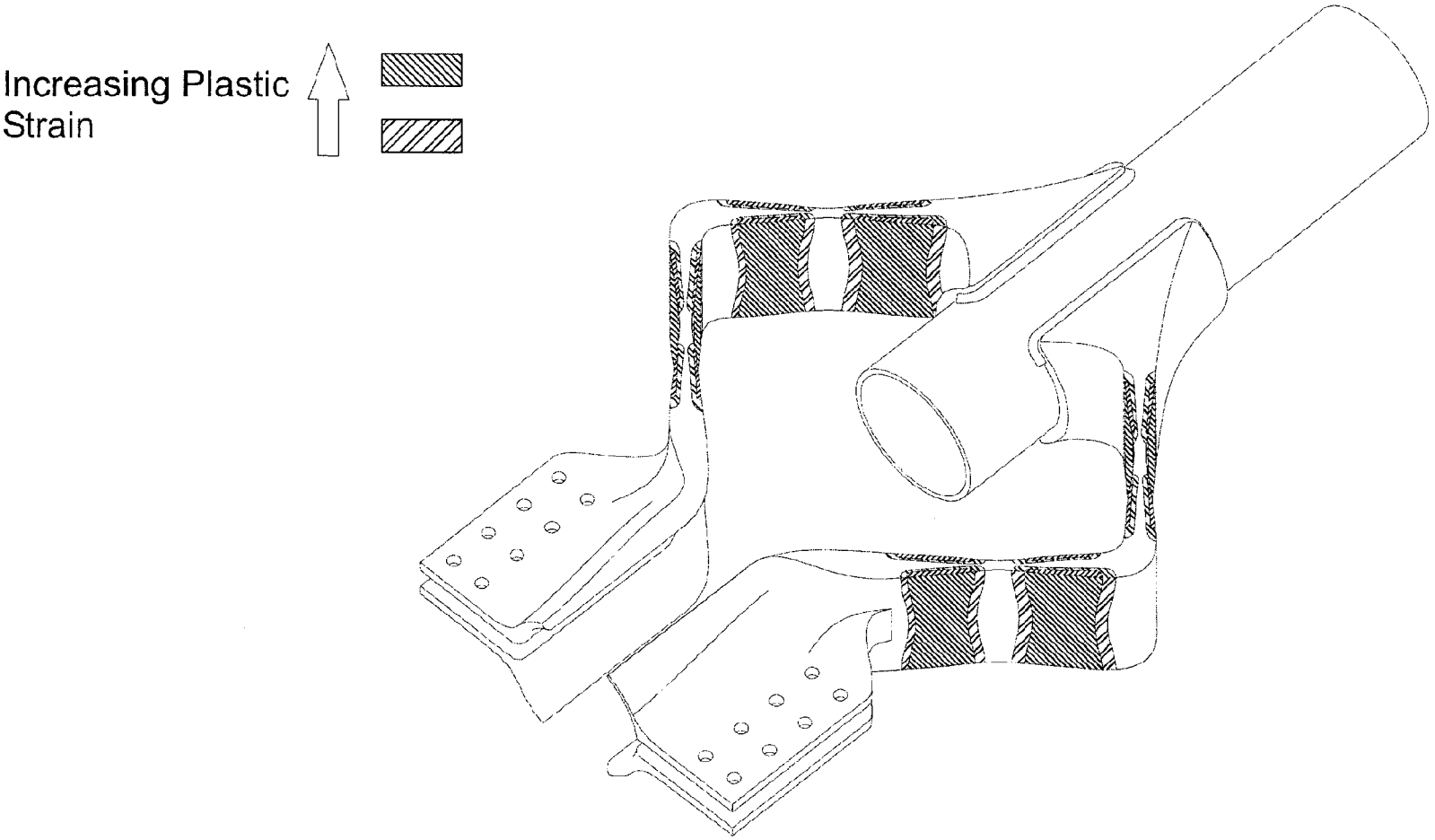
FIG. 17 illustrates plastic strain profiles obtained from non-linear finite element analysis of the yielding fuse member in accordance with a first embodiment of the present invention.
Figure 18:
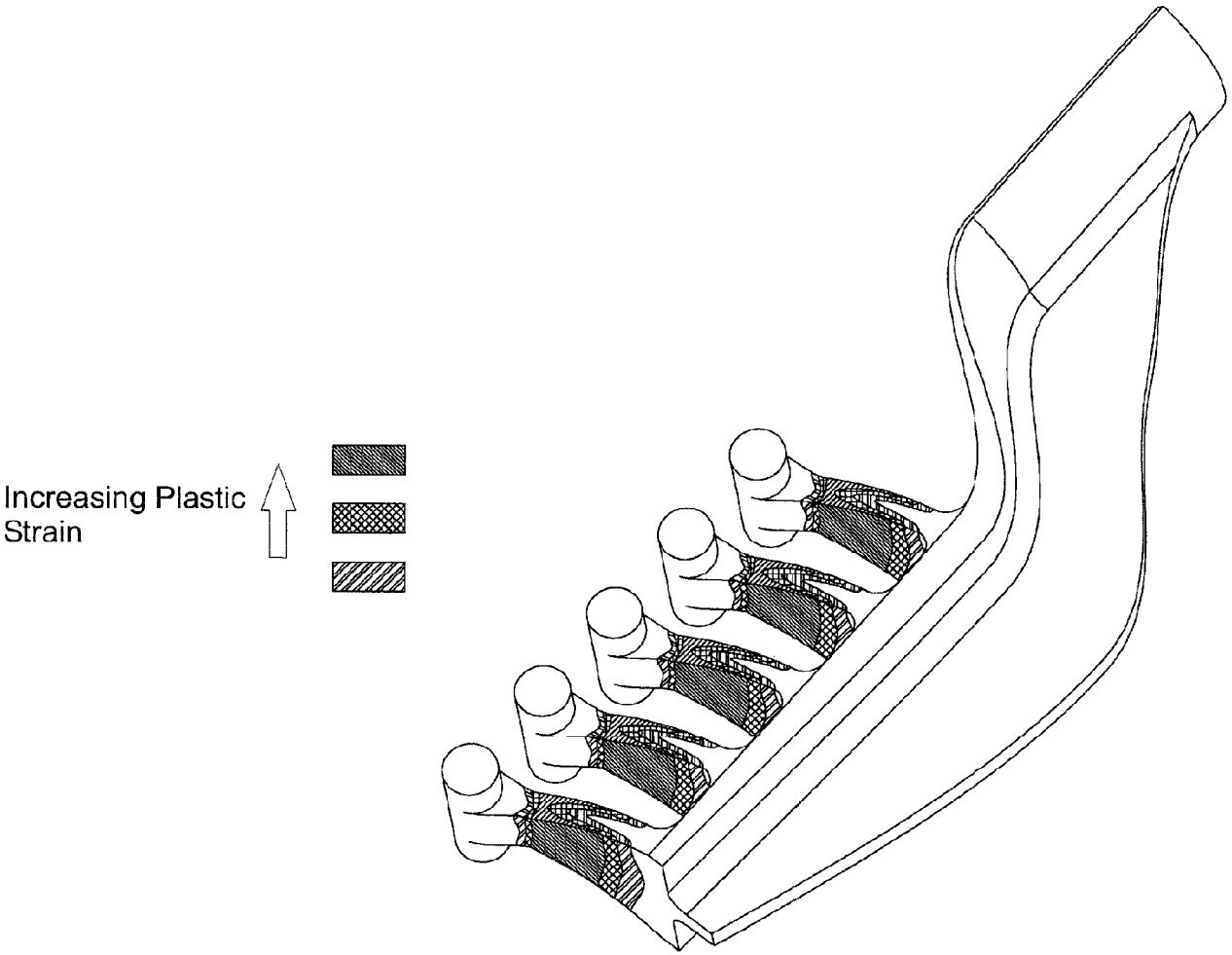
FIG. 18 illustrates plastic strain profiles obtained from non-linear finite element analysis of the yielding fuse member in accordance with a second embodiment of the present invention; and It is to be expressly understood that the description and drawings are only for the purpose of illustration and as an aid to understanding, and are not intended as a definition of the limits of the invention.

The yielding fuse devices of the present invention were examined using finite element analysis and laboratory tests. Cyclic load displacement plots showing the hysteretic response of the embodiments of the yielding device are provided in FIG. 13 for yielding device 10 in accordance with the first embodiment of the invention and FIG. 14 for yielding device 32 in accordance with the second embodiment of the invention. Static load displacement plots showing the response of the embodiments of the yielding device fuse 10 and 32 under compression or tension are provided in FIG. 15 and FIG. 16. FIG. 17 and FIG. 18 illustrate the equivalent (von-Mises) plastic strain distribution obtained from the numerical simulation in the embodiments of the yielding devices 10, 32.

Other embodiments of the present invention are of course possible, for example, as shown in FIGS. 9 and 11A the yielding fuse device of the present invention can be connected to a W-section instead of a hollow structural section by means of bolting (as shown) or welding (not shown). Other variations are possible, including: varying the number of arms in the yielding device; changing the geometry of the yielding arms; changing the means of connection between the yielding device, the brace member, and the structural frame, whether by welding, bolting or other means, and including one or more intermediate connections such as gusset plates; using brace members of different shapes and dimensions, etc.

It will be appreciated by those skilled in the art that the yielding devices of the present invention may be cast from various different materials. In particular, any suitable cast material is possible, especially castable steels. For example, ASTM A958 Grade SC8620 Class 80/50 steel, with Si content less than 0.55% by weight, would be a suitable material for the yielding devices. Also suitable would be ASTM A216/A216M WCB and ASTM A352/A352M LCB. Using these grades ensures that the yielding device is considered a weldable base metal. Different alloys and different types of steel may be used for the casting depending on the properties that are required for the particular application.

It will be appreciated that the above description is related to the invention by way of example only. Many variations on the invention will be obvious to those skilled in the art and such obvious variations are within the scope of the invention as described herein whether or not expressly described.

What is claimed is:

1. A structural device for use in a brace assembly for a structural frame, characterized in that the device comprises:

(a) an end portion configured to receive a brace member of the brace assembly whereby the end portion defines an axis along which it is connectable to the brace member; and (b) a body portion formed to be disposed away from the axis including at least one flexural yielding arm, the at least one flexural yielding arm extending toward the axis, being formed to achieve predominantly inelastic flexural deformation in response to dynamic loading conditions, and each of the at least one flexural yielding arm including:

(i) an outer edge portion connectable to the structural frame, and (ii) at least one tapered region being tapered in accordance with a geometry that is operable to cause the following response in the at least one flexural yielding arm to tension and compression exerted upon the structural device: flexural yielding of the entirety of the at least one flexural yielding arm; absorption of a majority of energy; and wholly near-constant curvature of the at least one flexural yielding arm.

2. The device of claim 1 characterized in that the at least one yielding arm is tapered along a length of the yielding arm.

3. The device of claim 1 characterized in that the structural device is a cast structural device.

4. The device of claim 1, characterized in that the geometry of the at least one flexural yielding arm permits control of:

(a) the force at which the flexural yielding arm yields;

(b) the elastic and post yield stiffnesses of the flexural yielding arm; and (c) the displacement associated with the onset of fuse yielding.

5. A brace assembly for a structural frame, characterized in that the brace assembly comprises:

(a) a brace member, said brace member defining a longitudinal axis; and (b) at least two structural devices, each device including:

(i) an end portion configured to receive the brace member and be connected to the brace member; and (ii) a body portion disposed generally away from the longitudinal axis defined by the brace member, the body portion including a plurality of yielding arms extending substantially perpendicularly from the body portion toward the longitudinal axis, the yielding arms including outer edge portions adapted to be connected to the structural frame.

6. The brace assembly of claim 5, characterized in that there are two cast structural devices.

7. The brace assembly of claim 5, characterized in that the brace assembly further comprises a splice plate and a brace assembly end connection for connecting the brace assembly to the structural frame, wherein the splice plate is configured to retain the outer edge portions of the yielding, arms and the brace assembly end connection.

8. The brace assembly of claim 7, characterized in that the outer edge portions are retained by the splice plate by bolt means.

9. The brace assembly of claim 7, characterized in that the end connection is a gusset plate and the splice plate has holes corresponding to holes in the gusset plate to allow the splice plate to be retained to the gusset plate by means of bolting.

10. The brace assembly of claim 7, characterized in that the splice plate includes two opposing portions for retaining the outer edge portions of the yielding arms.

11. The brace assembly of claim 7, characterized in that the splice plate comprises: a first end for retaining the outer edge portions of the yielding arms; a second end for connection to the assembly end connection; and an intermediate section between the first end and the second end.

12. The brace assembly of claim 7, characterized in that the splice plate extends beyond the assembly end connection such that a gap is formed between one of the at least two structural devices and the assembly, end connection, Wherein said gap comprises a length that is at least twice the maximum expected axial brace deformation during a dynamic loading condition.

13. The brace assembly of claim 12, characterized in that a gap is formed between the brace member and the body portion of at least one of the at least two structural devices.

14. The brace assembly of claim 5, characterized in that the brace member does not extend beyond the end portion of at least one of the at least two structural devices.

15. The brace assembly of claim 5, characterized in that the yielding arms are tapered along a length of the yielding arms.

16. The brace assembly of claim 5, wherein the at least two structural devices when connected to the brace member and the structural frame absorb a majority of energy during dynamic loading conditions.

17. The brace assembly of claim 16, characterized in that the dynamic loading conditions include severe seismic loading conditions.

18. The brace assembly, of claim 5, characterized in that at least one of the at least two structural devices acts as a yielding fuse when the structural frame is subjected to dynamic loading conditions.

19. The brace assembly of claim 18, characterized in that the geometry of the flexural yielding arm permits control of:

(a) the force at which the yielding fuse yields;

(b) the elastic and post yield stiffnesses of the yielding fuse;

(c) the displacement associated with the onset of fuse yielding; and (d) damping of the structural frame.

20. The brace assembly of claim 5, characterized in that the brace member is tubular and the end portion includes a curvature corresponding to a: curvature of the brace member.

21. The brace assembly of claim 5, characterized in that the yielding arms of each of the at least two structural devices are operable to flexurally yield when the brace member moves axially either toward or away from the end connection.

22. The brace assembly of claim 5, characterized in that the brace assembly further comprises a means for attaching a distal end of the brace member to the frame.

23. The brace assembly of claim 5, characterized in that the at least two structural devices are cast structural devices.

24. The brace assembly of claim 5, characterized in that the structural device serves to protect the brace member and the structural frame from damage during dynamic loading conditions.

25. A brace assembly for a structural frame comprising:

(a) a brace member, said brace member defining an axis; and (b) at least one structural device, each device including:

(i) a first end configured to receive the brace member and, be connected to the brace member;

(ii) a second end adapted to be connected to the structural frame said second end and first end being within or virtually within the axis defined by the brace member; and (iii) at least one flexural yielding arm disposed between the first end and the second end, said at least one flexural yielding arm being offset from the axis of the brace member, being formed to achieve predominantly inelastic flexural deformation in response to dynamic loading conditions, and being tapered in accordance with a geometry that is operable to: control the force at which the structural device yields; and cause the entirety of the at least one flexural yielding arm to yield flexurallv upon tensile or compressive loading of the brace assembly;

wherein when the structural device is connected to the brace member the structural device absorbs a majority of energy during dynamic loading conditions, including tensile or compressive loading of the brace assembly.

26. The brace assembly of claim 25, characterized in that the brace assembly comprises two or more structural devices implemented in the brace assembly such as to provide symmetrical yielding during loading in an axial direction.

27. The brace assembly of claim 25, characterized in that the brace assembly further comprises a splice plate and a brace assembly end connection for connecting the brace assembly to the structural frame, wherein the splice plate is configured to retain one or more outer edge portions of the at least one flexural yielding arm and the brace assembly end connection.

28. The brace assembly of claim 27, characterized in that the outer edge portions are retained in the splice plate by means of bolting.

29. The brace assembly of claim 27, characterized in that the end connection is a gusset plate and the splice plate has holes corresponding to holes in the gusset plate to allow the splice plate to be retained to the gusset plate by means of bolting.

30. The brace assembly of claim 27, characterized in that the splice plate includes two opposing portions for retaining the outer edge portions of the at least one flexural yielding arm.

31. The brace assembly of claim 27, characterized in that the splice plate comprises: an outer edge portion end for retaining the outer edge portions of the at least one yielding arm; a end connection end for connection to, the assembly end connection; and an intermediate section between the outer edge portion end and the end connection end.

32. The brace assembly of claim 27, characterized in that the splice plate extends beyond the assembly end connection such that a gap is formed between the at least one structural device and the assembly end connection, wherein said gap comprises a length that is at least twice the maximum expected axial brace deformation during a dynamic loading condition.

33. The brace assembly of claim 32, characterized in that a gap is formed between the brace member and the body portion of the at least one structural device.

34. The brace assembly of claim 25, characterized in that the brace member does not extend beyond the first end of the at least one structural device.

35. The brace assembly of claim 25, characterized in that the at least one yielding arm is tapered along a length of the at least one yielding arm.

36. The brace assembly of claim 25, characterized in that the brace member is tubular and the first end includes a curvature corresponding to a curvature of the brace member.

37. The brace assembly of claim 25, characterized in that the at least one structural device is as cast structural device.

38. The brace assembly of claim 25, characterized in that the at least one structural device serves to protect the structural frame from damage during dynamic loading conditions.

39. The brace assembly of claim 38, characterized in that the dynamic loading conditions include severe seismic loading conditions.

40. The brace assembly of claim 25, characterized in that the at least one structural device acts as a yielding fuse when the: structural frame is subjected to dynamic loading conditions.

41. The brace assembly of claim 40, characterized in that the geometry of the flexural yielding arm permits control of:

(a) the force at which the yielding fuse yields;

(b) the elastic and post yield stiffnesses of the yielding fuse;

(c) the displacement associated with the onset of fuse yielding; and (d) damping of the structural frame.

42. The brace assembly of claim 25, characterized in that the at least one flexurally yielding arms of each of the at least one structural device is operable to flexurally yield when the brace member moves axially either toward or away from the first end or the second end.

43. The brace assembly of claim 25, characterized in that the brace assembly further comprises a means for attaching a distal end of the brace member to the structural frame.

* * * * *